United States Patent [19]

Henning

[11] 3,934,810

[45] Jan. 27, 1976

[54] FLEXIBLE MOLD

[75] Inventor: Robert J. Henning, Crystal Lake, Ill.

[73] Assignee: The Quaker Oats Company, Chicago, Ill.

[22] Filed: Dec. 4, 1974

[21] Appl. No.: 529,336

[52] U.S. Cl. ..... 249/117; 249/127; 264/313; 425/440; 425/DIG. 44

[51] Int. Cl.[2] ..... B28B 7/06; B28B 7/20

[58] Field of Search..... 249/82, 117, 66 R, 66 A, 249/127, 183, 134, 179, 177, 178, 150–153; 264/DIG. 50, 19, 230, 313, 314, 318, 335, 334, 336; 425/803, DIG. 57, DIG. 58, 440, 441, DIG. 3, DIG. 11, DIG. 14, DIG. 42, DIG. 60; 164/228; 156/249, 500, 412, 416

[56] References Cited

UNITED STATES PATENTS

| | | | |
|---|---|---|---|
| 1,551,603 | 9/1925 | Melosi | 249/178 |
| 1,828,075 | 10/1931 | Saunders | 249/173 X |
| 1,942,993 | 1/1934 | Aultman | 264/DIG. 50 |
| 1,983,602 | 12/1934 | Daubenmeyer | 264/DIG. 50 |
| 2,187,260 | 1/1940 | Brandenburg | 249/183 X |
| 2,196,258 | 4/1940 | Erdle | 264/313 X |
| 2,267,610 | 12/1941 | Jone | 264/318 X |
| 2,271,454 | 1/1942 | Erdle | 264/313 X |
| 2,537,915 | 1/1951 | Roop | 249/127 X |
| 2,739,350 | 3/1956 | Lampman | 425/DIG. 44 |
| 3,776,683 | 12/1973 | Putzer | 425/DIG. 44 |

*Primary Examiner*—Francis S. Husar
*Assistant Examiner*—John S. Brown
*Attorney, Agent, or Firm*—Joseph P. O'Halloran

[57] ABSTRACT

A flexible distensible mold for use in fabricating art forms and utilitarian articles, and for use with the aid of air pressure differential enlargement of the shaping cavity is provided with closeable slits extending from at least portions of the outside surface of the mold partly into the mold. With these improved molds, the withdrawal bore of the shaping cavity can be greatly enlarged and the side walls can be greatly extended with lower air pressure differentials than would be otherwise necessary. In addition, the closed slits permits the use of thicker walls and thus provide additional support for the weight of the shaped article particularly when formed in elongated molds.

3 Claims, 10 Drawing Figures

FLEXIBLE MOLD

Flexible distensible molds can be used to shape art forms as well as utilitarian material such as hardenable foundry sand mixes for the production of cores and molds. After a hardenable mixture is placed in the shaping cavity and hardens at least to some extent, the shaping cavity of flexible distensible molds can be enlarged by air pressure differential to such an extent that the shaped article with undercut regions can be withdrawn from the flexible mold.

Patents relating to such molds include U.S. Pat. No. 2,124,871 to C. L. Beal and U.S. Pat. No. 3,776,663 to Putzer.

Continued development in connection with the use of flexible distensible molds, such as, for example, in the production of foundry cores, have uncovered several serious problems.

For example, it has been found to be difficult to faithfully reproduce the dimensions of a pattern when flexible distensible material is used to make the mold, because the weight of the material being shaped such as, for example, hardenable sand mixes, causes so much distension of the stretchable mold material that the "distension" becomes appreciable distortion. This is particularly a problem in the case of elongated articles in which a rather long column of mold-material and shaped material must be supported by the cottom portions of the flexible mold. In many foundry applications the standards for performance are so strict that the core's dimensions must be true within 1/32 inch.

One approach taken to stabilize the dimensions of the cavity during filling with foundry sand results in molds being made from flexible distensible material having relatively thick walls. This, in turn, had led to other problems, particularly in connection with removing the resulting shaped articles from the mold by air pressure differential. Many articles have a body portion which is of substantially greater radius or diameter than that portion of the article which is formed in the neck or filling channel of the mold. Other articles have cavities or undercut regions which are shaped by protuberances extending into the shaping cavity from the mold wall. These articles are often extremely difficult to withdraw through the relatively small diameter bore of the neck of the mold even after air pressure differential is applied. Inasmuch as the presently contemplated mode for increasing the size of the cavity relies on forces generated by an air pressure differential between the exterior and the interior surface of the mold, the vacuum method soon becomes an unattractive method for opening or enlarging mold cavities in molds which require very thick walls to stabilize the dimensions of the cavity, if one were to rely only on prior technology.

In accordance with the present invention, the flexible distensible elastomeric molds are provided with closed, openable slits extending radially inwardly from at least portions of the external surface of the mold, only partly through the mold wall. Planer slits are preferred. Thus, provision of slits in accordance with this invention keeps the walls of the mold impermeable to the passage of air therefrom, and allows the molds to be used, as described hereinafter, in conjunction with vacuum pots and other air pressure differential means for cavity enlargement for easy removal of the shaped articles therefrom. Thus, molds constructed in accordance with this invention have been found to allow for relatively easy extraction of patterns and hardenable shaped articles, such as shaped foundry sand articles, from the mold cavity. This is particularly true in connection with those molds requiring relatively great enlargement of the exit from the shaping cavity and in which the wall thicknesses are relatively great. These slits provide a hinging action because the slits which are "closed" when the material is "at rest", open wide during the application of pressure differential to provide mold cavity enlargement far beyond that which can be achieved in connection with the mere stretching of the entire non-slitted walls by distending the relatively thick flexible wall cavity at any given pressure differential.

The invention and particularly preferred embodiments thereof are described hereinafter with the aid of the accompanying drawings in which.

Figure 1:
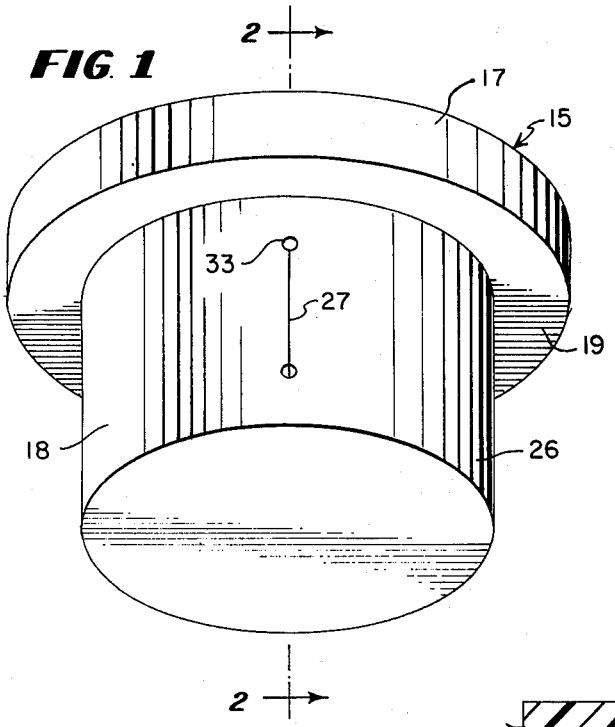
FIG. 1 is a perspective view of a mold in accordance with the present invention.
Figure 2:
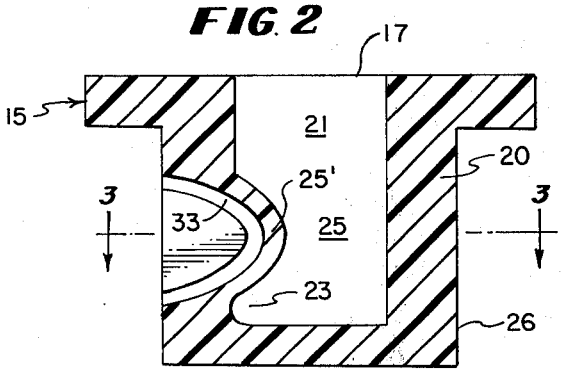
FIG. 2 is a horizontal elevational cross-sectional view taken approximately along the line 2—2 in FIG. 1.
Figure 3:
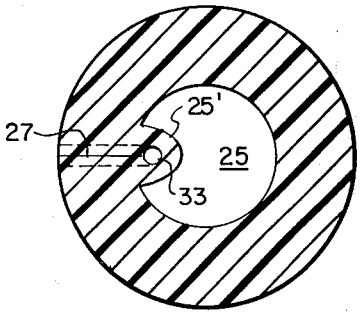
FIG. 3 is a cross-sectional view taken approximately along the line 3—3 of FIG. 2.

In the accompanying drawings of flexible distensible molds in accordance with the present invention generally indicated by the numeral 15, mold 15 is made of flexible distensible elastomeric material, and is of integral construction. Much literature and numerous patents describe the manufacture of flexible molds from elastomeric material, and the particular materials used does not constitute part of the invention and is not discussed herein for that reason. Mold 15 includes a top portion 17, a body portion 18, and a radially extending flange portion 19. A shaping cavity 21 includes a relatively wide body portion 23 and a relatively narrow undercut portion 25. Mold 15 also includes a slit 27 which extends from the outer surface 26 partway through the wall 20. Slit 27 terminates in a rounded marginal channel 33. Respective walls 27, 27″ of slit 27 abut against one another when the mold is "at rest" as shown in FIG. 1, and as seen in FIG. 3. It is seen in FIGS. 2 and 3 that slit 27 and channel 33 extend into only a portion of the mold wall 20 at the thickest portion 25′ thereof namely at that portion 25′ of wall 20 which corresponds to narrow cavity section 25.

It is noted that when the mold is in its "at rest" configuration, as shown in FIG. 3, slit 27 is "closed". That is, the walls 27′, 27″ thereof abut against each other. It is further noted that the slit 27 does not extend all the way through wall 20 and therefore hardenable material which is being shaped cannot enter into the slit 27 and furthermore air cannot pass from the cavity 21 into slit 27.

Figure 4:
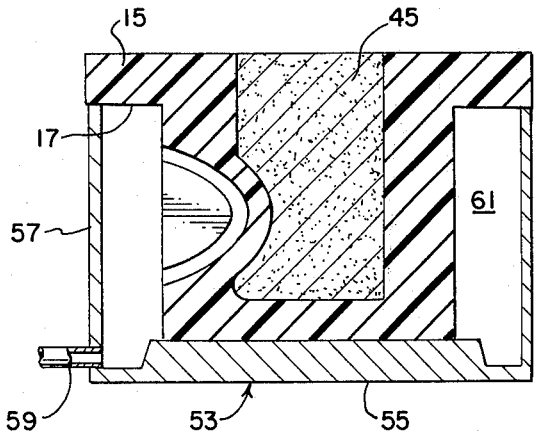
FIG. 4 is a cross-sectional elevational view of the mold in accordance with the present invention in a mold-vacuum box assembly utilizing the mold shown in FIG. 1.
Figure 5:
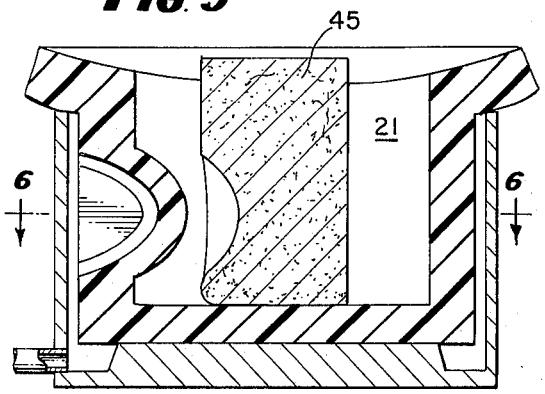
FIG. 5 is a diagrammatic illustration using the view along the vertical mid-section plane, as in FIG. 4, showing the relative position of elements of the assembled mold-vacuum box after vacuum is applied.
Figure 6:
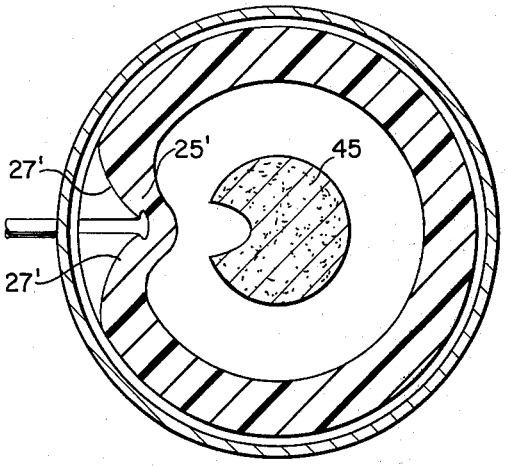
FIG. 6 is a horizontal cross-sectional view taken approximately along the lines 6—6 in FIG. 5.

FIGS. 4 and 5 illustrate the use of the mold 15 in accordance with the present invention. Mold 15, in accordance with the present invention, is shown diagrammatically illustrated in place in a vacuum pot generally indicated by the numeral 53. Vacuum pot 53 includes a bottom wall of 55 which is slightly elevated and upon wich the bottom of mold 15 resides. Pot 53 also includes side walls 57 which extent upwardly to abut against and sealingly engage the radially extending flange portion 17 at the bottom thereof. Vacuum conduit 59 passes through side wall 57 and into the annular air space 61 constituting the gap between mold 51 and pot 53. When a vacuum is applied to air space 61, as a consequence of the withdrawal of air from air space 61 through conduit 59, the relatively higher atmospheric air pressure within mold cavity 21, causes the mold 15, and particularly the shaping cavity 21 to enlarge until the mold 15 reaches the configuration shown in FIGS. 5 and 6. It is noted that projection 25' has moved radially and that side walls 27', 27'' of slit 27 have pivoted with respect to one another and that the rounded channel 33 has been stretched somewhat as shown in FIG. 6. The enlargement of cavity 25 is such that protuberance 25' has moved laterally a sufficient distance to permit the shaped article 45 to be lifted axially from the shaping cavity 21.

In FIG. 6 it is also apparent that the pivoting of walls 27', 27'' with respect to each other permits the protuberance 25' to contribute to the circumferencial dimension of the shaping cavity 21 in the region 25', during the expansion of shaping cavity 21 to atmospheric pressure differential.

The rounded channels or marginal portions 33 of slit 27 are optional but highly preferred structures in accordance with the present invention and are found to greatly extend the life of the mold by arresting a tendency of split propagation through mold wall 20.

Figure 7:
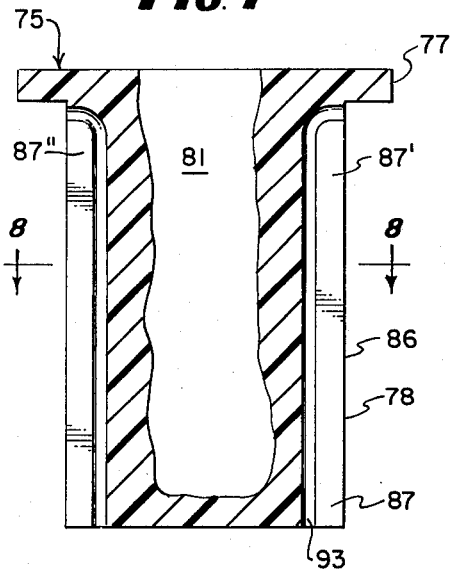
FIG. 7 is a cross-sectional elevational view of an alternative embodiment in accordance with the present invention.
Figure 8:
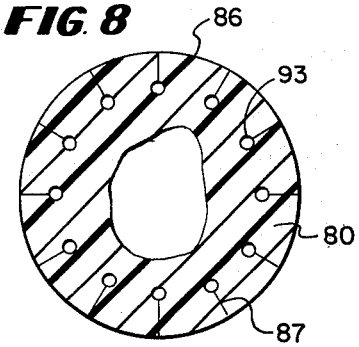
FIG. 8 is a cross-sectional view taken approximately along the line 8—8 of FIG. 7.

The figures discussed hereinbefore namely FIGS. 1–6 relate to one preferred aspect of the present invention. FIGS. 7 and 8 relate to another preferred aspect of the present invention. In FIG. 7 a mold in accordance with the present invention is generally indicated by the numeral 75, and this mold 75 is made of a flexible distensible material as was mold 15. Mold 75 has numerous structural similarities with mold 15 including extended annular flange portion 77 having body portion 78 dependent therefrom, body portion 78 having an external wall surface 86. A plurality of slits 87 extend partway through wall 80 radially inwardly toward shaping cavity 81 and terminate in a rounded channel 93. Each of the slits and terminal channels are substantially identical, and thus only one of the slits 87 will be discussed in detail. Opposing walls 87', 87'' of each respective slit 87 abut against each other, and, as illustrated in FIG. 8, slit 87 extends substantially the entire length of body portion 78. When mold 75 is used in conjunction with a vacuum pot such as that illustrated in FIGS. 4, 5 and 6 the operation of the mold 75 in accordance with the present invention is similar to that of the operation of mold 15, except that mold 75 is shown as having a plurality of slits 87, and each of the slits 87 opens by a pivoting of walls 87' and 87'' with respect to its respective opposing counterpart namely, with respect to each other so that only a portion of wall 20 between the respective channels 93 and cavity 81 undergoes any substantial stretching or distension upon application of differential atmospheric pressure. When the cavity 81 is filled with a hardenable sand mix 45, for example, as illustrated in FIGS. 4, 5, and 6 in connection with mold 15, the wall 20 is of sufficient thickness to assist in the supporting, without slump of the lower portions of the mold due to the weight of the packed material, and, furthermore, the face-to-face opposition of respective walls 87', 87'' against each other results in additional non-distorting support for the weight of the sand article in cavity 81 and for the weight of mold 75.

Figure 9:
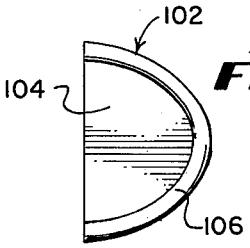
FIG. 9 is a perspective elevational view of a pattern used to form the slits in the embodiment shown in FIGS. 1–3.
Figure 10:
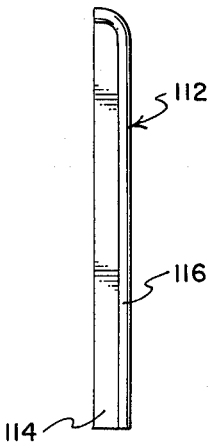
FIG. 10 is a perspective view of a pattern used to form the slits in the embodiment shown in FIGS. 7–8.

Patterns for shaping slits 27, 87 and channels 33, 93 are illustrated in FIGS. 9 and 10 respectively. In FIG. 9 a pattern is generally indicated by the numeral 102 and pattern 102 includes a film portion 104 and enlarged rounded marginal portion 106. Film portion 104 results in the formation of slit 27 and enlarged marginal portion 106 results in the formation of channel 33. The liquid polymerizable material from which mold 15 is formed flows around pattern 102 during the fabrication of mold 15, and pattern 102 is, of course, removed after the liquid material cures to working condition. In FIG. 10 a pattern which is used to provide slits 87 and marginal channels 93 is generally indicated by the numeral 112. Pattern 112 includes a film portion 114 and an enlarged rounded portion 116. Film portion 114 results in the shaping of slit 87 and enlarged rounded portion 116 results in the shaping of channel 93.

The illustrative embodiments have been shown for illustrative purposes only, and it is understood that given the disclosure herein, many variations and combinations can be made without departing from the spirit and scope of the present invention. For example, the number of slits provided is not critical, and one or more slits can be utilized. Also, for example, the slits can be positioned, in accordance with the present invention, only along portions of the outer wall of the mold 15, and on the other hand, can be positioned to extend the entire axial dimension of the body of the mold. The use of enlarged marginal channels 33, 93 is particularly preferred but optional, and channels 33, 93 can be rounded ends of the respective slits or of circular cross-section or of oval cross-section. It is noted that the thickness of the wall of the mold is substantially reduced at the radially inward extreme of the slit, and it is also noted that the cavity-expanding movement and extension of the flexible distensible elastomeric mold under air pressure differential, the respective walls of the slit separate from one another and yet the integrity of the shaping cavity as an air-confining cavity remains intact. Also, inasmuch as the cavity has no slits extending therefrom there is no "flash" created on the sand article.

We claim:

1. In an integral flexible distensible mold having a wall portion defining a shaping cavity therein, the improvement comprising: a closed openable slit in said wall portion, said slit extending from at least a portion of the exterior of the wall of the mold and only partly through the wall of the mold wherein no part of the slit extends into the shaping cavity and in which the slit includes an enlarged radially inward marginal portion thereof at the inner extreme thereof.

2. A flexible distensible mold having walls defining a shaping cavity, said mold having extending radially inwardly into said wall from the exterior surface of said mold a closed, openable slit which extends from the top of said body portion and in which the slit extends only partly through the wall of the mold, no part of said slit extending to the shaping cavity of the mold and in which the slit includes an enlarged marginal portion thereof at the inner extreme thereof.

3. A flexible distensible mold having a radially extending flange portion at the top thereof, and having a body portion depending from such flange portion, and a shaping cavity extending through the top portion and into the body portion, said mold having a closed, openable slit to at least a portion of the mold, said slit extending from at least a portion of the outer surface of the body portion, and only partway through the mold, no part of said slit extending into said shaping cavity, and in which the slit terminates at its inward extreme with an enlarged portion thereof.

* * * * *